US010539368B2

(12) United States Patent
Girardi

(10) Patent No.: US 10,539,368 B2
(45) Date of Patent: Jan. 21, 2020

(54) HEAT TREATMENT OF FIREWOOD

(71) Applicant: KILN DRYING SYSTEMS & COMPONENTS, INC., Hendersonville, NC (US)

(72) Inventor: Robert Girardi, Arden, NC (US)

(73) Assignee: Kiln Drying Systems & Components, LLC, Hendersonville, NC (US)

( * ) Notice: Subject to any disclaimer, the term of this patent is extended or adjusted under 35 U.S.C. 154(b) by 213 days.

(21) Appl. No.: 15/154,602

(22) Filed: May 13, 2016

(65) Prior Publication Data

US 2016/0273837 A1 Sep. 22, 2016

Related U.S. Application Data

(60) Provisional application No. 62/273,116, filed on Dec. 30, 2015.

(51) Int. Cl.

| | |
|---|---|
| ***F27B 9/26*** | (2006.01) |
| ***F27B 5/12*** | (2006.01) |
| ***F26B 9/06*** | (2006.01) |
| ***F26B 23/02*** | (2006.01) |
| ***F26B 21/02*** | (2006.01) |

(52) U.S. Cl.

CPC ..... *F26B 9/06* (2013.01); *F26B 21/02* (2013.01); *F26B 23/02* (2013.01); *F26B 2200/24* (2013.01)

(58) Field of Classification Search

CPC .. F26B 9/06; F26B 21/02; F26B 23/02; F26B 2200/24; A01M 19/00

See application file for complete search history.

(56) References Cited

U.S. PATENT DOCUMENTS 2,834,120 A 4/1958 Greenhood
3,070,896 A * 1/1963 Knudson ..... F26B 9/06 34/219

(Continued)

FOREIGN PATENT DOCUMENTS

JP 11082960 A * 3/1999

OTHER PUBLICATIONS

Bob MacGregor, Designing Kilns for Firewood, 2009, NEKDA, http://www.esf.edu/nekda/documents/FirewoodKiln-BobMacGregorNEKDAfall2009.pdf.*

(Continued)

*Primary Examiner* — Steven S Anderson, II

(74) *Attorney, Agent, or Firm* — Kevin E Flynn; Flynn IP Law

(57) ABSTRACT

Heat treating firewood in basket using a kiln having a burner side placement area and an opposite side placement area for receiving baskets containing firewood. The two placement areas separated by a set of downcomers that provide heated air. Loading the kiln with baskets of firewood through the use of at least one of the first end wall and the second end wall. Applying a charge to heat the baskets of firewood. The application of the charge circulating heated air for the kiln from the mixing chamber and returning the heated air to the kiln through the supply duct till the dry bulb temperature reaches an initial target temperature above 230 degrees Fahrenheit. After reaching the initial target temperature for dry bulb temperature, increasing the wet bulb temperature depression target while working to maintain the dry bulb temperature within a selected tolerance with respect to the initial target temperature.

24 Claims, 6 Drawing Sheets

(56) References Cited

U.S. PATENT DOCUMENTS

| | | | | | |
|---|---|---|---|---|---|
| 3,939,573 | A | | 2/1976 | Berti | |
| 4,289,237 | A | | 9/1981 | Cutara | |
| 4,294,295 | A | | 10/1981 | Olin | |
| 4,431,405 | A | * | 2/1984 | Eatherton | B01D 39/04 110/102 |
| 4,597,189 | A | | 7/1986 | Cutrara | |
| 5,050,738 | A | | 9/1991 | McAdams | |
| 5,195,251 | A | * | 3/1993 | Gyurcsek | F26B 21/02 34/191 |
| 5,226,244 | A | * | 7/1993 | Carter | F26B 21/026 34/191 |
| 5,276,980 | A | * | 1/1994 | Carter | F26B 21/026 34/191 |
| 5,363,568 | A | | 11/1994 | Cloer | |
| 5,491,958 | A | | 2/1996 | Hammer | |
| 5,699,646 | A | | 12/1997 | Hammer | |
| 5,772,830 | A | | 6/1998 | Hasegawa | |
| 6,012,266 | A | | 1/2000 | Koskinen | |
| 6,219,937 | B1 | * | 4/2001 | Culp | F26B 21/004 34/218 |
| 6,401,433 | B2 | | 6/2002 | McCown | |
| 6,910,835 | B2 | | 6/2005 | Spangler | |
| D590,491 | S | | 4/2009 | Kirk | |
| 8,453,343 | B2 | | 6/2013 | Emery | |
| 9,200,834 | B1 | | 12/2015 | Ball, Jr. | |
| 9,423,176 | B1 | | 8/2016 | Girardi | |

OTHER PUBLICATIONS

Boone et al, Dry Kiln Schedules for Commercial Woods, 1988, https://www.fpl.fs.fed.us/documnts/fplgtr/fplgtr57.pdf, p. 120.*

Celtic Logs, Kiln Dried Irish Hardwood Logs, May 17, 2014, https://web.archive.org/web/20140517035139/http://celticlogs.ie/.*

SII, SII Dry Kilns, Mar. 21, 2012, http://www.siidrykilns.com:80/item_details.aspx?catID=47&prodID=31.*

Simpson, William T. et al, Kiln-Drying Time of Split Oak Firewood, Forest Products Laboratory Research Note FPL-RN-0254, Aug. 1987, 6 page, United States Department of Agriculture, Forest Service, Forest Products Laboratory, Madison, WI, United States of America.

Don't Be Delayed at the Border—Make Sure Your Firewood Is Heat Treated, Program Aid No. 1999, Jun. 2015, 2 pages (one in English and one in French), United States Department of Agriculture, Animal and Plant Health Inspection Service, Washington DC, United States of America.

Calabrese, Diane M., William A. Day Jr. & Sons, Inc. Chooses Firewood Kiln from SII Dry Kilns, Timberline Magazine, Jan. 26, 2016, (1 page showing firewood baskets), Industrial Reporting, Inc., Ashland, Virrginia, United States of America.

Note—This entry corrects the date for NPL3 of IDS_1 from Jan. 26, 2016 to Jan. 2016 as the 26 was a page number. Calabrese, Diane M., William A. Day Jr. & Sons, Inc. Chooses Firewood Kiln from SII Dry Kilns, Timberline Magazine, Jan. 2016, 4 pages (page 26 showing firewood baskets in kiln), Industrial Reporting, Inc., Ashland, Virginia, United States of America.

Calabrese, Diane M.,Kiln-Direct Installs New Commercial Wood Waste Firewood Kiln at Tetreault & Son Forrest Management, Timberline Magazine, Jan. 2016, 3 pages (page 20 has firewood baskets in kiln) Industrial Reporting, Inc., Ashland, Virginia, United States of America.

Wang, Xiping et al., Heat Treatment of Firewood—Meeting the Phytosanitary Requirements, General Technical report FPL-GTR-200, 37 pages, United States Department of Agriculture Forest Service Forest Products Laboratory, Jul. 2011.

* cited by examiner

100

100

FIG. 9
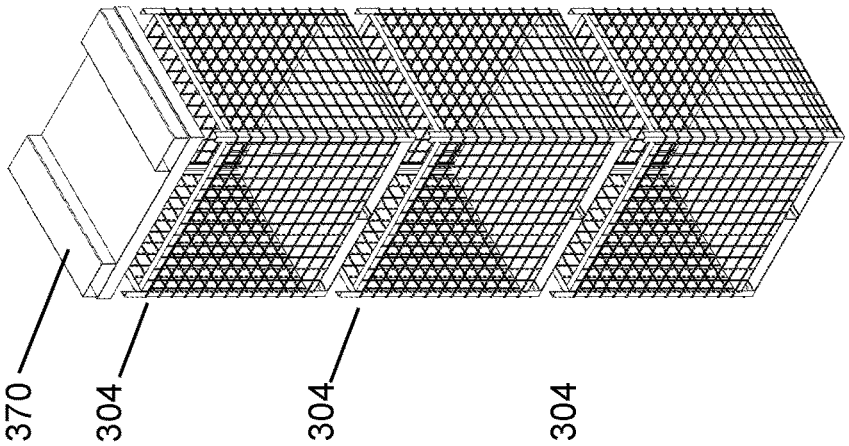
FIG. 8
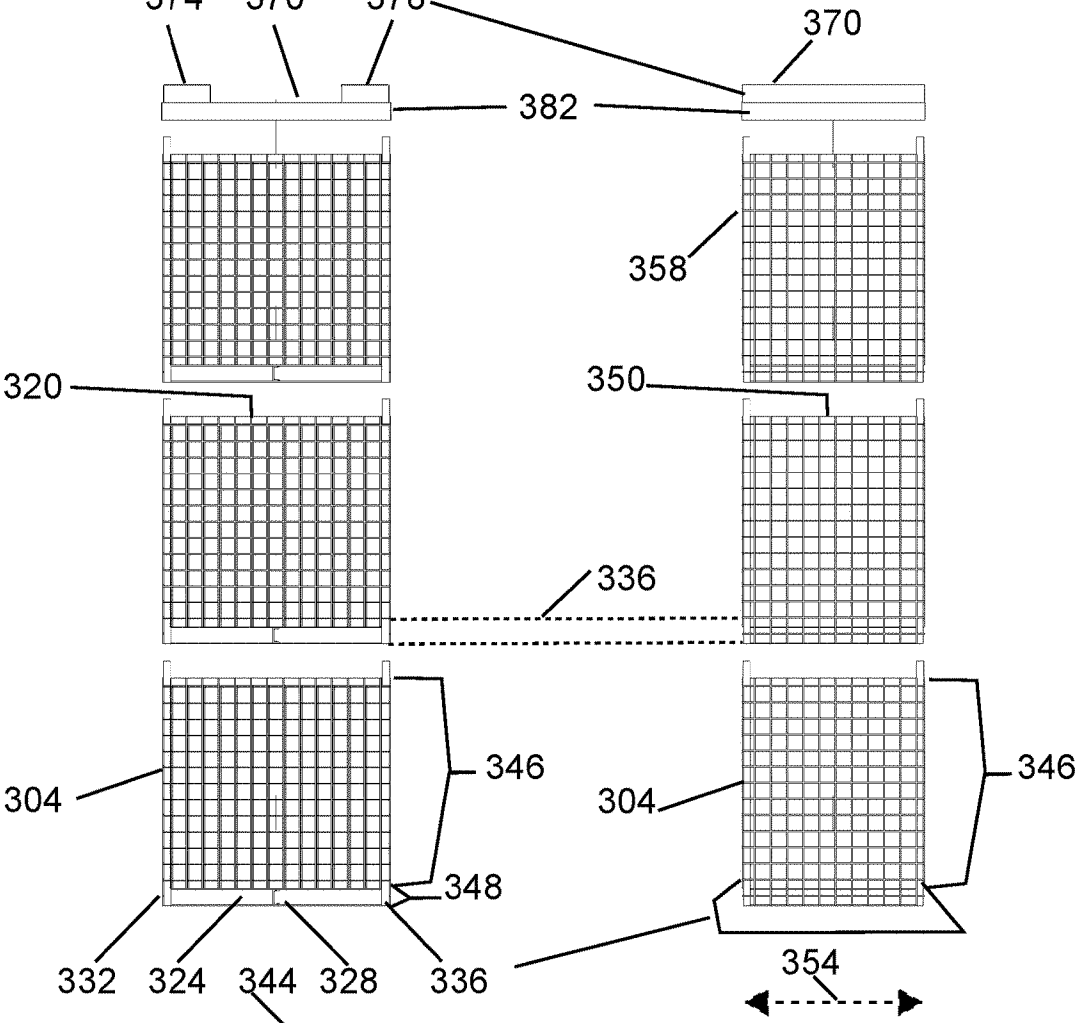
FIG. 7

HEAT TREATMENT OF FIREWOOD

This application claims the benefit of commonly assigned U.S. Provisional Patent Application No. 62/272,116 filed Dec. 30, 2015 titled Firewood Kilns Using Track Kiln Features. The '116 application is incorporated by reference in its entirety.

BACKGROUND

Field of the Disclosure

This disclosure relates generally to batch kilns that are used to heat and dry firewood (alternatively called cordwood).

Background

Firewood Production.

Firewood (also known as cord wood or cordwood) is typically made from oak or other hardwoods, cut into lengths 12 to 18 inches long and split to form sticks 2 to 4 inches in diameter. To make firewood safe for interstate transportation, the USDA requires that the innermost fibers of firewood must be heated to a minimum of 60° C. (140° F.) for a minimum of 60 minutes to assure the destruction of Emerald Ash Borer (*Agrilus plantpennis*), as specified under 7 CFR § 301.53. Lumber harvested for firewood from living trees must also be dried from an initial moisture content near 100% water content by weight on a dry basis to a moisture content level less than the 20% water to make the firewood suitable for burning in hearths and wood stoves.

Firewood Kilns.

A Wisconsin Forest Products Laboratory study, titled "Kiln-Drying Time of Split Oak Firewood" (Simpson, W. T., Boone, R. S., Chem, J., and Mace, T., 1987), provides the anticipated treatment hours required to attain 20% moisture content. At temperatures of 140° F., 180° F., and 220° F., the respective treatment times are given as 260, 90, and 30 hours. This study also showed no difference in drying time between random and oriented fire wood stacking arrangements.

Firewood is typically randomly loaded in large metal baskets that have short legs so that the basket can be moved by fork lift. The basket has an open top and four corner extensions that extend upward beyond the top. These four corner extensions receive the legs from a basket placed above and prevent the basket legs from an upper basket from slipping off the lower basket. Alternatively, the basket could have an integrated pallet which receives the forks of a fork lift.

The four side walls of the basket have openings to allow movement of heated air through the basket walls to heat treat the firewood. The dimensions of the baskets shown in these drawings are about five feet tall (plus the height of the legs).

SUMMARY OF THE DISCLOSURE

Aspects of the teachings contained within this disclosure are addressed in the claims submitted with this application upon filing. Rather than adding redundant restatements of the contents of the claims, these claims should be considered incorporated by reference into this summary.

This summary is meant to provide an introduction to the concepts that are disclosed within the specification without being an exhaustive list of the many teachings and variations upon those teachings that are provided in the extended discussion within this disclosure. Thus, the contents of this summary should not be used to limit the scope of the claims that follow.

Inventive concepts are illustrated in a series of examples, some examples showing more than one inventive concept. Individual inventive concepts can be implemented without implementing all details provided in a particular example. It is not necessary to provide examples of every possible combination of the inventive concepts provide below as one of skill in the art will recognize that inventive concepts illustrated in various examples can be combined together in order to address a specific application.

Other systems, methods, features and advantages of the disclosed teachings will be immediately apparent or will become apparent to one with skill in the art upon examination of the following figures and detailed description. It is intended that all such additional systems, methods, features and advantages be included within the scope of and be protected by the accompanying claims.

BRIEF DESCRIPTION OF THE FIGURES

The disclosure can be better understood with reference to the following figures. The components in the figures are not necessarily to scale, emphasis instead being placed upon illustrating the principles of the disclosure. Moreover, in the figures, like reference numerals designate corresponding parts throughout the different views.

FIG. 7 shows a stack of three baskets as viewed from one of the two loading sides.

FIG. 8 shows the same stack of three baskets 304 from FIG. 7 but from one of the two non-loading sides that are ninety degrees offset from the loading sides.

FIG. 9 is a top side, loading side, and non-loading side perspective view of the stack of three baskets and a lid shown in FIG. 7 and FIG. 8.

DETAILED DESCRIPTION

Figure 1:
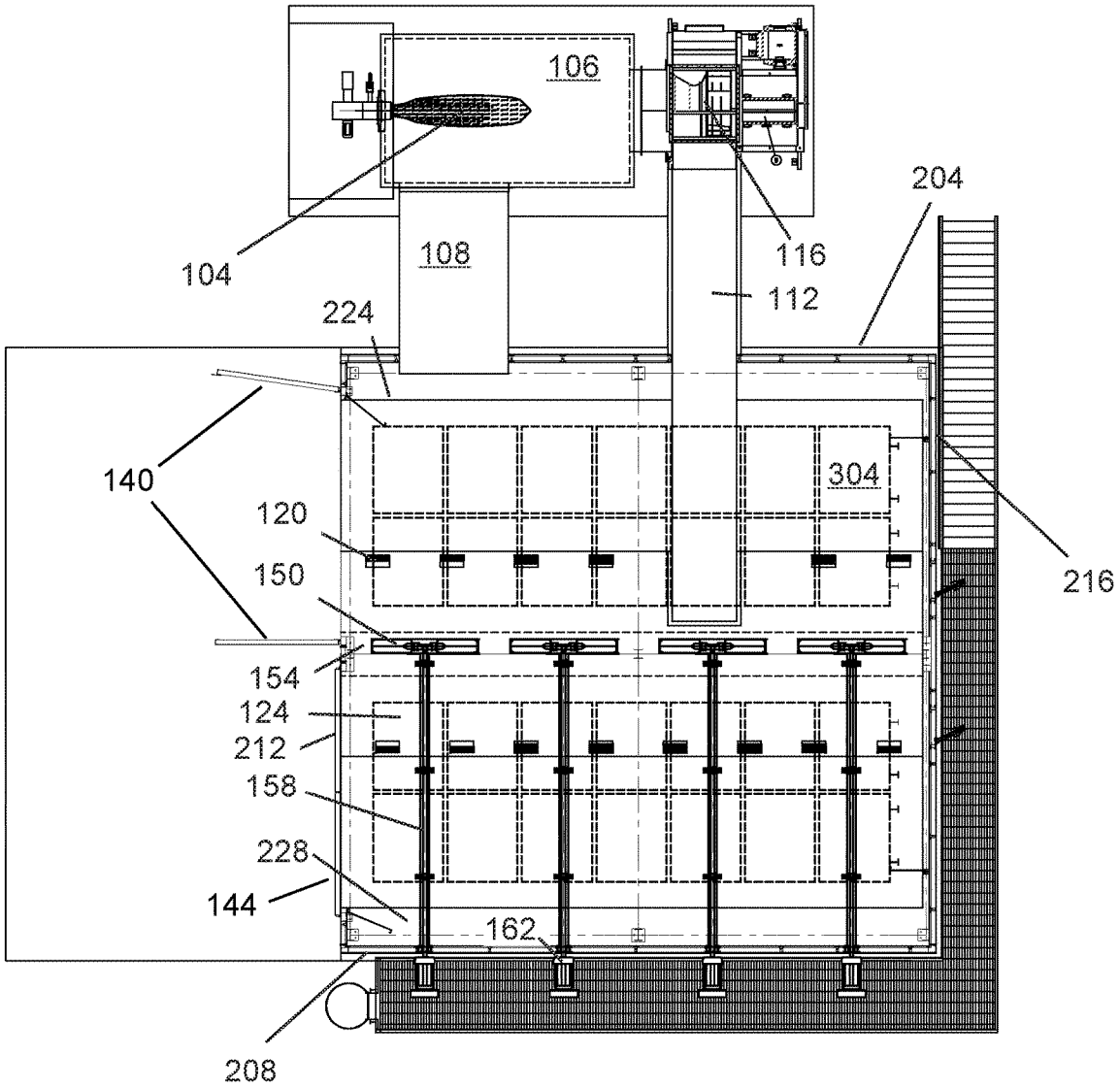
FIG. 1 is the top view of a kiln 100 that may be used for drying and heat treating firewood.

The teachings of the present disclosure may be used to create a kiln with the ability to dry 42 cords of firewood comprised of variable hardwood tree species and possessing unknown initial water contents to a certified pest-free heat treated condition with a moisture content less than 20% on a dry basis in less than 24 hours. The time may be driven down to 22 hours when baskets are used with basket walls that provide less resistance to the movement of the heated air, and additional steps are taken to minimize or prevent air bypassing the containerized wood. Having a kiln drying time on the order of 22 hours allows a kiln to be unloaded, reloaded, and restarted approximately 24 hours after the last start so that the routine from day to day is consistent.

The teachings of the present disclosure call for use of high temperature drying to heat treat the firewood. Thus, rather than using the temperature settings normally used for oak lumber or firewood, (temperatures not exceeding 220 degrees Fahrenheit dry bulb temperature with unregulated wet bulb), the kiln is operated at dry bulb temperatures that exceed 220 degrees Fahrenheit. The dry bulb temperature may be set in a range of 230 to 260 degrees Fahrenheit dry bulb temperature with a web bulb temperature of set 60 to 100 degrees Fahrenheit less than the dry bulb temperature. It is important to remember that it is difficult to maintain uniform temperatures throughout the kiln given the impact of evaporative cooling and other factors. So an average measured temperature of 260 degrees Fahrenheit should be deemed to include the possibility that some localized hot spots exist that are warmer than 260. Thus, to avoid risk of fire or setting off fire suppression sprinklers, the dry bulb set point is not likely to be set significantly above 260 degrees Fahrenheit.

The firewood kiln may be used as shown below without the inclusion of tracks. Such a kiln may be used with baskets loaded by forklift. The baskets may contain firewood or other small random wood lengths such as finger joint boards. Baskets of firewood and separate baskets containing finger joints can be dried at the same time.

One example is discussed in detail below. Those of skill in the art will appreciate that kilns of other sizes could be made using the teachings of the present disclosure. There is no requirement that the capacity of the kiln be at or near 42 cords.

Figure 2:
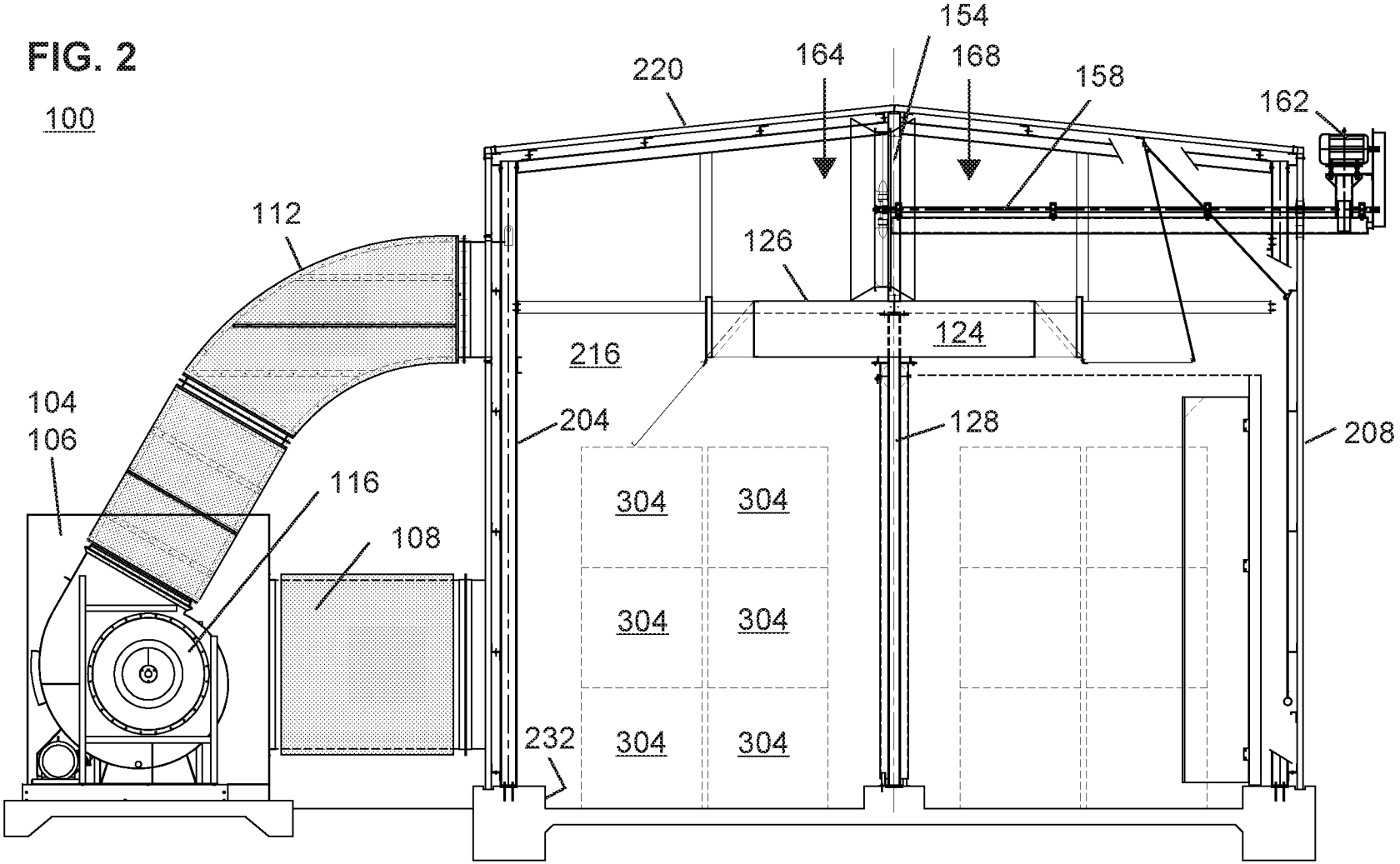
FIG. 2 is a front side view of kiln 100 with the front wall 212 removed.

FIG. 1 is the top view of a kiln 100 that may be used for drying and heat treating firewood. To make relevant components visible, the roof 220 (FIG. 2) is not shown in FIG. 1. FIG. 2 is a front side view of kiln 100 with the front wall 212 removed. Many major components of kiln 100 are visible in FIG. 1 and FIG. 2.

The kiln 100 has internal dimensions of 34 feet across (from burner side wall 204 to opposite side wall 208) and 33 feet deep (between front wall 212 and rear wall 216) with a peak ceiling height near 28 feet tall. The kiln 100 is designed with a level area of concrete floor sufficient for package loading 84 baskets 304 stacked three high in four rows of seven baskets per row. Dimensions for the basket 304 are 5 feet wide (loading face), 4 feet deep (parallel to set of downcomers 124), and 64 inches high (including the short legs), with each basket 304 holding approximately one half cord of firewood. Details of baskets 304 are discussed in connection of FIG. 7, FIG. 8, and FIG. 9.

FIG. 1 and FIG. 2 show a burner 104 connected to the kiln 100 by a return duct 108 which returns air from the kiln 100 to the mixing chamber 106 and the mixture of hot gas from the burner 104 is combined with the return air from the kiln 100 in the mixing chamber 106. The mixture of hot gas from the burner 104 with the return air from the kiln 100 is pushed back to the kiln 100 through a supply duct 112 by the recirculation blower 116. Inside the kiln 100, the heated air is distributed through a heat distribution duct 124 and disbursed into the kiln 100 through openings 120 with adjustable slide gates. The heat distribution duct 124 which also serves as the fan deck 126. Additional openings in the bottom plate of this heat distribution duct 124 supply air downward through downcomers 128 that inject a curtain of heated air below the fan deck 126, between the two stacks of baskets 304. The downcomers 128 and upward facing openings 120 in the heat distribution duct 124 are sized so that about half the heated air is delivered through the downcomers 128. A series of fans 150 in the fan wall 154 above the fan deck 126 are driven by long rotating shafts 158 which penetrate through sealed openings in the kiln wall and are connected with belt drives to fan motors 162 located external to the kiln. The burner side wall 204 of the kiln 100 is on the side of the kiln 100 closest to the burner 104. In this kiln 100, the fan motors 162 are located so that the shafts 158 go through the opposite side wall 208 to avoid requiring the shaft of the fan in-line with the supply duct from penetrating the supply duct. Other layouts are possible.

FIG. 1 includes two open burner side doors 140 and two closed opposite side doors 144. The kiln 100 in FIG. 1 is loaded via doors 140 and 144 on the front wall 212 between the burner side wall 204 and the opposite side wall 208.

To promote uniformity in the processing of the firewood, the direction of rotation of the fans 150 in the fan wall 154 may be periodically reversed. When the fans 150 are operated to push air from the burner side 164 of the fan wall 154 to the opposite side 168 of the fan wall 154, the air pressure on the opposite side 168 of the fan wall 154 is sufficiently high that little flow comes out the openings 120 of the distribution duct 124 on the opposite side 168 of the fan wall 154. In this fan direction, air pressure is low on the burner side 164 of the fan wall 154 and thus heated air comes out of the openings 120 of the distribution duct 124. While some warm air leaves through the return duct 108 and comes back to the kiln 100 via the supply duct 112, much of the air is circulated:

- from the fans 150 in the fan wall 154 over the fan deck 126,
- down the opposite side plenum gap 228 between the opposite side edge of the fan deck 126 and the opposite side wall 208;
- through the baskets 304 on the opposite side 168 of the fan wall 154;
- through plenum gaps between adjacent downcomers 128;
- through the baskets 304 on the burner side 164 of the fan wall 154;
- up the burner side plenum gap 224 between the burner side edge of the fan deck 126 and the burner side wall 204; and
- across the burner side portion of the fan deck to the burner side 164 of the fan wall 154.

When the fan motors 162 are operated in the opposite direction, the fans 150 in the fan wall 154 push air from the opposite side 168 of the fan wall 154 to the burner side 164 of the fan wall 154. When the opposite side 168 of the fan wall 154 is the low pressure side, the bulk of the heated air delivered though upward facing openings 120 in the heat distribution duct 124 will pass through openings in the top of the distribution duct 124 on the opposite side 168 of the fan wall 154. The flow of air circulating through the kiln 100 by the fans 150 will be the reverse of the path described above.

The kiln 100 shown in these drawings is equipped with a 15 MMBtu/hr natural gas burner 104, a 75 HP recirculation blower 116, and four 72 inch kiln fans 150, each with 25 HP fan motors 162 mounted outside of the kiln walls. The burner 104 projects heat into a mixing chamber, which is located near the inlet of the recirculation blower 116.

Figure 3:
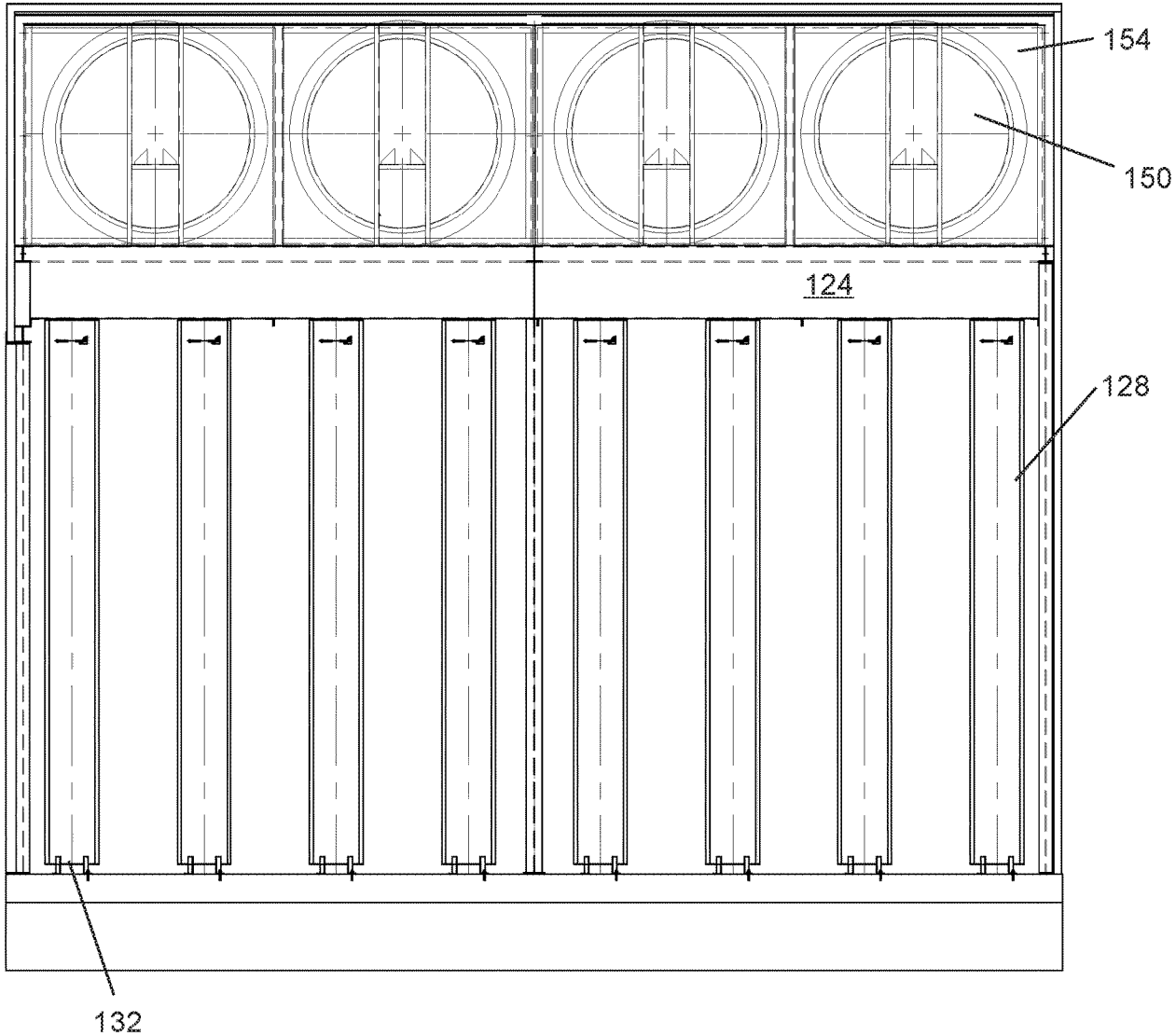
FIG. 3 shows a cross section of the kiln 100 that reveals the fan wall 154 with fans 150 and the downcomers 128 below the heat distribution duct 124.

FIG. 3 shows a cross section of the kiln 100 that reveals the fan wall 154 with fans 150 and the downcomers 128 below the heat distribution duct 124. The heated air exits slots (not visible here) on both sides of each downcomer 128 along a centerline of the row of downcomers 128. The downcomer 128 may also have openings 132 at the bottom of the downcomer 128. The heated air forms an air curtain to optimize mixing of heated air with the fan driven air circulating through the baskets 304 (not shown here). There may be adjustable baffles to allow the flow rate to be adjusted in the entrance to each downcomer 128. Likewise, the upward facing openings 120 in the heat distribution duct 124 may be adjustable through the use of slide gates which can be set to partially cover each upward facing opening 120 so that the distribution of heated air may be balanced. Note that there are significant open spaces between adjacent downcomers 128 to allow for heated air circulated by the fans 150 to move through the row of downcomers 128. Overhead baffles (discussed below) help keep the circulating air from passing above the baskets 304 and below the heat distribution duct 124. One of skill in the art might cover the tops of the top baskets 304 to reduce or eliminate air bypassing the wood through the air space above the baskets.

Returning to FIG. 2, the curbs 232 keep air from circulating between the legs of the lowest set of baskets 304. As noted, the short legs are used to allow a fork lift to place forks between the legs and under the flat bottom of the basket 304 containing firewood. As noted below, an alternative basket design has fork pockets facing the door and sidewalls to prevent the circulating heated air from flowing under the firewood. When using baskets that block air flow from passing beneath the basket, there is not a benefit in adding curbs to the kiln.

Baffles.

Figure 4:
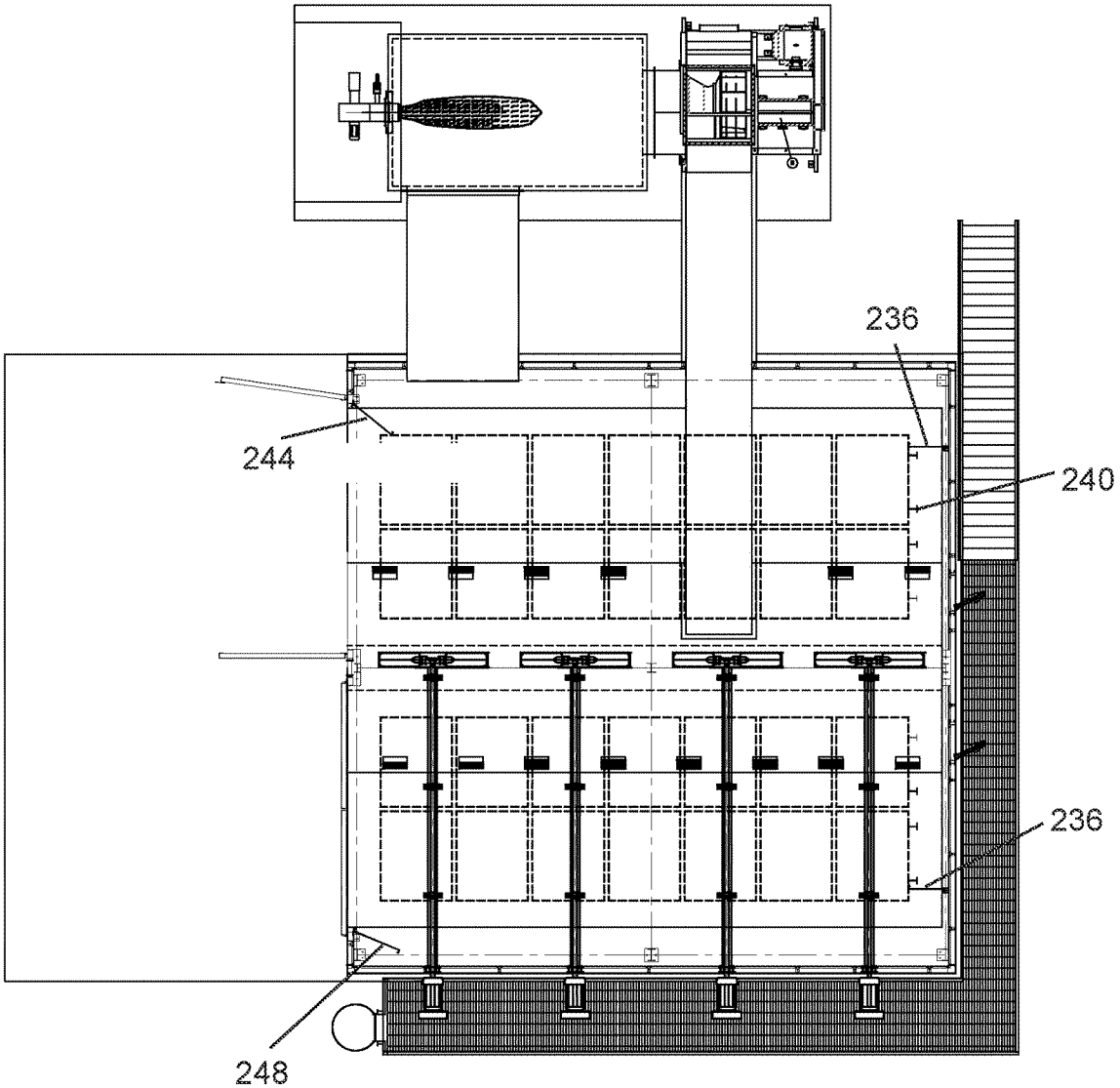
FIG. 4 is the same top view as FIG. 1 but has the baffle components highlighted.

In addition to the curbs 232 mentioned above, a set of baffles may be used to decrease the amount of air circulating within the kiln that does not pass through the baskets 304. Air that is not passing through the baskets 304 is not assisting with the drying and heat treatment of the firewood in the baskets. FIG. 4 is the same top view as FIG. 1 but has the baffle components highlighted. A pair of rear baffles 236 extends out from the rear wall 216. The rear baffles 236 may be immobile as they are aligned with a set of end stops 240 on the kiln floor which limit the movement of baskets 304 towards the rear wall 216. The use of the rear baffles 236 keeps air from moving from the fan outlet to the fan inlet along the rear wall 216 without engaging the firewood in the baskets 304.

Figure 5:
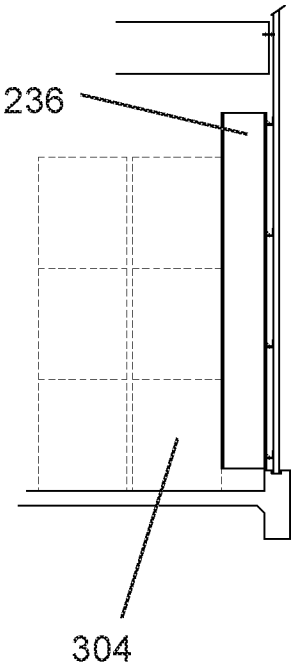
FIG. 5 is side view of a rear baffle 236 and positioned to be adjacent to a stack of three baskets 304.

FIG. 5 is side view of a rear baffle 236 and positioned to be adjacent to a stack of three baskets 304. The rear baffle 236 may include a gap above the floor as that pathway for airflow substantially obstructed by the end stops 240 which would decrease the flow of air under the rear baffles 236.

Returning to FIG. 4, a pair of side wall baffles 244 and 248 is shown. Side wall baffle 244 is shown in the engaged position. Side wall baffle 248 is shown in the loading position. The side wall baffles 244, 248 near the kiln doors may be spring loaded or secured with chains to press the baffle edges against the nearby baskets 304 but can be moved from the engaged position shown by side wall baffle 244 to a loading position as shown by side wall baffle 248 that is out of the way of forklifts loading or unloading baskets 304 into the kiln. The spring force or other placement mechanism is sufficient to maintain the position of the side wall baffle 244 (or 248 when moved to the engaged position) against the baskets 304 even when the circulating air presses to move the side wall baffle 244 or 248 away from the basket 304.

Figure 6:
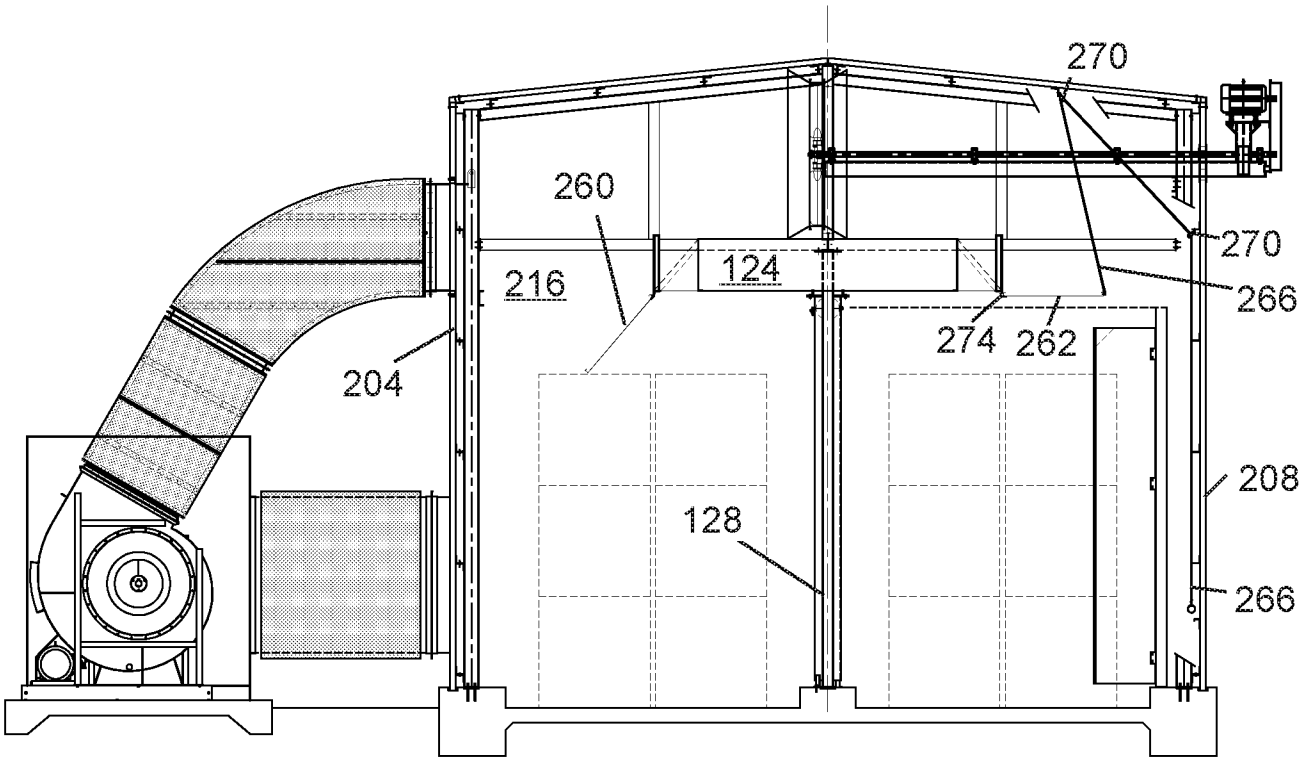
FIG. 6 is a front end view of kiln 100 with the front wall 212 removed illustrating overhead baffles 260 and 262.

FIG. 6 is a front end view of kiln 100 with the front wall 212 removed (see FIG. 1). Overhead baffles 260 and 262 are noted in FIG. 6. The overhead baffles 260 and 262 run the length of the set of baskets (seven baskets in this example). The overhead baffle 260 near the burner side wall 204 is shown in its engaged position resting across the frames of the upper baskets 304. The overhead baffle 262 near the opposite side wall 208 is shown in the loading position where the overhead baffle 262 is elevated out of the way of the fork lifts that lift and move the baskets 304 to load and unload the kiln 100. One arrangement of a cable 266 and pulleys 270 to lift the distal end of overhead baffle 262 around a hinge 274 is shown. The corresponding cable, pulleys, and hinge are not shown and labeled for overhead baffle 260 to avoid clutter in the drawing. Other tools such as electric winches could be used to lift and lower the overhead baffles 260 and 262.

The overhead baffles 260 and 262 prevent large amounts of circulating air from passing above the top set of baskets 304 and below the heat distribution duct 124. Note that as these baskets 304 are being moved into and out of the kiln by forklifts rather than via carts on tracks, there needs to be ample room for the baskets 304 to be manipulated without hitting the heat distribution duct 124 or downcomers 128.

The kiln 100 disclosed is a package kiln but with a non-traditional spacing of baskets 304 with wood to be heat treated. The circulating heated air comes down a plenum on one side (204 or 208) of the kiln 100, traverses a relatively short depth of baskets 304 with wood, is reheated by the heated air exiting the downcomers 128, and traverses another relatively short depth of baskets 304 with wood before exiting by the plenum on the other side wall (208 or 204) to return to the inlet side of the fan wall 154.

The speed and uniformity of drying of the firewood is promoted by having the heated air traverse no more than 12 feet and preferably no more than 10 feet across the firewood before receiving additional heat. This is in sharp contrast to the practice in prior art package kilns which typically had depths of wood to be treated of 16 to 24 feet.

Material Choices.

A preferred material for the interior of the kiln 100 is stainless steel or aluminum alloy surfaces and structural components with corrosion resistant material properties suitable for exposure to the corrosive acid condensates that are present when drying hardwoods at temperatures above 212 degrees Fahrenheit. The baskets 304 and ductwork may be made of mild steel rather than stainless steel or aluminum alloys as these surfaces are less likely to receive condensation and thus less likely to corrode.

Controls.

The kiln could be equipped with programmable logic controller ("PLC") kiln controls to monitor, record, and certify heat treatment compliance with interstate or international transportation regulation.

The controls may be linked to roof vents that may be opened as needed to release heated air with substantial humidity in order to keep the wet bulb temperature below the desired set point, resulting in a lower humidity associated with a greater difference between dry bulb temperature and wet bulb temperature. The kiln will have roof vents on the burner side and the opposite side of the fan wall but only the roof vents on the discharge side of the fans will be opened to vent.

The process may work to heat a set of green firewood as quickly as possible to get the circulating air to the desired dry bulb temperature. After the initial achievement of the dry bulb set point, the wet bulb depression may be increased so that the wet bulb temperature is moved down to final wet bulb set point without prolonged venting that would depress the dry bulb temperature below a tolerance of the desired set point.

At the end of the process, the kiln 100 may be cooled rapidly by opening the roof vents and loading doors so that the kiln 100 may be cooled sufficiently for removal of the baskets 304 of firewood.

Set Point Examples.

The teachings of the present disclosure may be used with a range of dry bulb set points. Table A provides examples of dry bulb set point, and two different levels of web bulb depression.

TABLE A

| | Wet Bulb Depression | |
|---|---|---|
| Dry Bulb Set Point | 60 Degrees leads to | 100 Degrees leads to |
| 260 Degrees Fahrenheit | Wet bulb of 200 Degrees Fahrenheit | Wet bulb of 160 Degrees Fahrenheit |
| 230 Degrees Fahrenheit | Wet bulb of 170 Degrees Fahrenheit | Wet bulb of 130 Degrees Fahrenheit |

Thus a kiln may be operated to initially ramp the dry bulb temperature up to 260 degrees Fahrenheit. Once the dry bulb temperature has been maintained for a prescribed period of time, the kiln may be vented to rid the kiln of humid air in order to slowly increase wet bulb depression. The roof vents are opened only on the fan outlet side of the fan wall. The venting process may be limited so that the dry bulb temperature does not dip below the target by more than an allowable tolerance (perhaps 5 or 10 degrees Fahrenheit). This process continues with the burner operating at full capacity until the wet bulb set point is reached. Once the wet bulb temperature is being maintained, the amount of venting will decrease. The burner may need to be operated at below full capacity in order to keep the dry bulb temperature from exceeding the target temperature of 260 degrees Fahrenheit.

A wet bulb depression of 60 degrees for a wet bulb temperature of 200 degrees Fahrenheit may be suitable for one application. An operator seeking a quicker treatment time (such as wanting to get the treatment time down to 22 hours) may choose a higher wet bulb depression to hasten the drying process. Thus an operator may choose a wet bulb depression of 100 degrees rather than 60 degrees Fahrenheit to hasten the process.

Another kiln may be set to a dry bulb set point of 230 degrees Fahrenheit rather than 260 degrees Fahrenheit. The process could be similar to the one described above with an initial target to achieve the dry bulb set point followed by a target to achieve the dry bulb set point and the desired wet bulb depression. The wet bulb depression can be gradually increased by venting while maintaining the dry bulb set point within a tolerance until a final state of dry bulb set point and desired wet bulb depression. After this state is reached, it may be necessary to reduce the burner output to avoid exceeding the dry bulb set point. This final state may be maintained for the duration of the heat treatment process.

Those of skill in the art will recognize that a range of dry bulb set points between 230 and 260 degrees may be used. The target wet bulb depression could be in the range of 60 to 100 degrees.

Optionally, for a process that uses an elevated dry bulb set point and a large wet bulb depression (120 degrees rather than 100 degrees), the process may reduce the dry bulb temperature after reaching the desired wet bulb temperature in order to minimize the risk of fire as the wood is dried.

Significant Energy Savings.

A kiln built and operated consistent with the teachings of the present application may have a heat treatment time ("charge time") of less than 24 hours. This is about a quarter of the prior art package kiln processing that used a charge time of 96 hours. The increase in throughput for the kiln is a significant benefit of the teachings of the present disclosure.

A second benefit is a reduction in the energy costs to process a cord of wood.

Costs Associated with Processing 42 Cords via Prior Art.

A conventional side loaded package kiln was loaded with 84 baskets that were 5 feet wide, 4 feet deep, and 64 inches high (including the short legs), with each basket holding approximately one half cord of firewood. The baskets were stacked four wide, seven deep, and three high.

The prior art package kiln was heated to a dry bulb temperature of not exceeding 180 degrees Fahrenheit with the heated air making a single pass through the kiln and vented out rather than having a fraction recirculate to a burner mixing chamber. A powered exhaust continuously expelled spent gases to the surrounding atmosphere. The charge was held for 96 hours before opening the kiln doors to allow the kiln and the heat treated firewood to cool so that the baskets of firewood could be removed from the kiln.

In contrast a kiln created in accordance with the drawings set forth above and loaded with a set of baskets two wide, three high, and seven deep on a first side of the downcomers, and another set of baskets two wide, three high, and seven deep on the opposite side of the downcomers was operated to have a dry bulb temperature of 250 degrees Fahrenheit and operated to depress the wet bulb temperature via roof vents without significant depression of the dry bulb temperature. The charge was for 24 hours. Both kilns were used by the same operator and thus the source firewood is assumed to be comparable. Assuming a cost for natural gas at $5.35 per MCF and using $0.07 per Kilowatt hour. A standard cubic foot of natural gas is the amount found in a cubic foot at 60 degrees Fahrenheit and 14.73 pounds per square inch. A comparison of energy use is set forth below.

| Parameter | Prior Art Package Kiln | Kiln in accordance with this disclosure | Difference |
|---|---|---|---|
| Charge Length | 96 hours | 24 hours | Improved kiln had charge time that was ¼ of prior art. |
| Natural Gas | 150,000 standard cubic feet natural gas ($802.50) 3571 cubic feet natural gas per cord. | 116,000 standard cubic feet natural gas ($620.60) 2762 cubic feet natural gas per cord | Improved kiln gas usage was 22.7% less. |
| Electricity for Fans in Kiln | 7 fans × 5 HP (3.7 kW/fan) × 96 hours ($174.05 electrical energy) | 4 fans × 25 HP (18.5 kW/fan) × 24 hours ($124.32 electrical energy) | Improved kiln electricity for fans was 28.6% less. |

-continued

| Parameter | Prior Art Package Kiln | Kiln in accordance with this disclosure | Difference |
|---|---|---|---|
| Recirculation Blower | | 1 recirculation blower × 75 HP (55.5 kW) × 24 hours ($93.24 electricity per charge) | |
| Combined Energy Cost per Cord | $23.25 | $19.96 | 14.15% reduction in major energy costs. |

The table above shows a 14.15% savings per charge in total energy costs despite the use of a 75 HP recirculation blower, where this feature is totally absent in the prior art kiln. There will also be instruments and controls that consume some power. However, the significant cost savings in energy used to heat and dry the firewood will be much appreciated by kiln operators. With the potential for 6 times the weekly production capacity, this savings of $138.39 per charge could potentially be $41,517 per year (6 charges per week×$138.39 per charge×50 weeks per year).

Alternatives & Variations

Doors.

Doors on both the front and rear of the kiln. The drawings discussed above had doors that opened on one end of the kiln and a rear wall without doors. A kiln could be built with doors on both the front and rear wall. The rear baffles would be replaced with a second set of side baffles that can be moved out of the way during loading or unloading of the kiln.

One door could be on a first end wall (212 or 216) and used to load the space between the burner side wall 204 and the downcomers 128 and a second door on the opposite end wall (216 or 212) could be used to load the space between the opposite side wall 208 and the downcomers 128.

The present design uses a set of one or more end doors as opposed to doors on the side walls (walls parallel to the fan wall and to the set of downcomers).

More than One Set of Downcomers.

The teachings of the present disclosure could be used in a kiln with more than one set of downcomers. A first end-loaded treatment space could be filled with baskets between the opposite side wall and a first set of downcomers. A second end-loaded treatment space could be filled with baskets between the first set of downcomers and a second set of downcomers. A third end-loaded treatment space could be filled with baskets between the second set of downcomers and the burner side wall.

As with the example discussed above, this kiln with more than one downcomer would reheat air after the circulating air passes through a set of baskets. The number of sets of downcomers could be more than two if desired.

One of skill in the art will appreciate that as circulating air needs to traverse more than two sets of baskets, that the fans may need to operate to provide a larger pressure differential between the outlet and inlet side of the fan wall.

Basket Design.

An alternative to use of legs to elevate the flat bottom of the basket to allow lifting by a fork lift, one could use baskets with integrated metal pallets. It is common for pallets to have fork pockets to receive the forks of a fork lift to allow the fork lift to lift the pallet. The walls of the fork pockets or other walls parallel with the fork pockets will impede air flow perpendicular to the fork pockets. Fork pockets aligned with the doors on the end walls will be perpendicular to the circulation direction of heated air within the kiln. Baskets with fork pockets end loaded into the kiln will not provide a bypass path for circulating heated air.

Baskets should securely nest without interfering with the ability to lift an upper nested basket from a lower nested basket. In other words the baskets should be set to reversibly nest. Baskets with pallet sections that block the flow of air circulated by the fans could be used in kilns that do not have curbs.

Basket side screening would preferably have more than 60% open area and ideally more than 80% open area (more is better). Ample open area is needed to minimize resistance to air flow through the baskets.

Baskets would preferably have a relatively light weight sheet metal covers that could be installed and removed by fork lifts. This cover may extend slightly down the four side walls. This cover could be used to cover the top baskets in a stack to avoid air entering one side of the basket and passing out the top of the basket rather than passing through small gaps between pieces of the firewood. The cover may also be used to protect firewood in baskets from rain when the baskets are outside before and after the heat treating process.

Basket Size.

The example discussed above used baskets that were 5 feet wide (facing the door), 4 feet deep (parallel to set of downcomers 124), and 64 inches high (including the short legs), with each basket 304 holding approximately one half cord of firewood. Thus, the circulating air passing through adjoining two baskets was passing through only ten feet of firewood.

Other basket sizes may be used with the teachings of the present disclosure. Having larger baskets may mean that a forklift must carry only one basket at a time rather than a stack of several baskets. With a large enough basket, a larger forklift may be required.

While the example set forth above had baskets arranged two across in the direction of air circulation, this is not a requirement. Likewise, it is not a requirement that the stack of baskets be three high or seven deep. The length of the treatment area or the height of the treatment area could be more or less than shown in the example shown above. The ratio of length of the treatment area to the height of the treatment area could be different from the example shown above. The ratio of length of the treatment area to the width of the treatment area could be different from the example shown above. The ratio of width of the treatment area to the height of the treatment area could be different from the example shown above.

The teachings of the present disclosure do call for limiting the length of traverse of firewood by circulating air to approximately twelve feet or less, preferably ten feet or less.

Illustrated Basket Example.

FIG. 7 shows a stack of three baskets 304 as viewed from one of the two loading sides 320. FIG. 8 shows the same stack of three baskets 304 from FIG. 7 but from one of the two non-loading sides 350 that are ninety degrees offset from the loading sides 320. As shown in FIG. 7, on each basket 304, there are two fork pockets 324 and 328 to receive fork lift forks so that the basket 304 can be lifted and stacked. The fork lift pockets 324 and 328 include solid sidewalls 332 and 336. With the fork lift pockets 324 and 328 aligned towards the loading door or doors, the solid sidewalls 332 and 336 preclude airflow below a firewood portion 346 of the basket 304 and in the fork portion 348 of the basket 304. The width 344 of the loading side 320 may be wider than the width 354 of the non-loading side 350. The basket side screening 358 is relatively open. Preferably have more than 60% open area and ideally more than 80% open area (more is better).

FIG. 8 shows the basket side screening 358 extending down to cover the three fork portions 348 to cover sidewall 336. As noted above, airflow will not be able to pass through solid sidewall 336 and bypass firewood portion 346.

FIG. 7 and FIG. 8 show that the top of stack of baskets 304 is covered with a lid 370. The lid may have fork pockets 374 and 378 so that the lid 370 may be placed upon a basket 304 through the use of a fork lift. This lid may extend slightly down the four side walls of the basket 304 with lid side walls 382. This lid 370 could be used to cover the top basket 304 in a stack of baskets 304 to avoid air entering one side of the basket 304 and passing out the top of the basket 304 rather than passing through small gaps between pieces of the firewood.

FIG. 9 is a top side, loading side, and non-loading side perspective view of the stack of three baskets 304 and a lid 370.

FIG. 8 shows the lid 370 as viewed from the non-loading side. Note that lid side wall 382 and the lid fork pocket 378 at least partially block air from passing over the uppermost pieces of firewood.

Alternative Baffles.

The use of baffles to diminish the flow of heated air around the baskets rather than through the baskets is desirable. Examples of suitable baffles have been provided. These specific baffle details are not required in order to enjoy at least some of the benefits of the present disclosure. A kiln without any baffles at all would still benefit from the other teachings of this disclosure.

A kiln may be designed to use scrap conveyer belt material or some other pliable material to provide a baffle that may be used without moving the baffle out of the way during loading of kiln as the pliable baffle would move when contacted by forklift or a basket being moved by a forklift.

Heat Source.

The heat source shown in the drawings was a natural gas burner. Other fuels may be used. The heat source could be indirect rather than direct through use of heat exchangers heated with steam, hot water, oil, or other working fluids.

Alternatives to Roof Vents.

Although roof vents are a common tool for removing humidity from the kiln, other options are known to those of skill in the art. While the roof is the typical location for kiln vents to release humid air, the kiln could be vented in a location other than the roof. Another example of a tool to remove humidity is that dehumidifier units may be placed in the kiln to remove water vapor. The term dehumidifying means includes the use of kiln vents, including roof vents, and the use of dehumidifying units.

Integrated USDA Test Instruments.

As noted above, to make firewood safe for interstate transportation, the USDA requires that the innermost fibers of firewood must be heated to a minimum of 60° C. (140° F.) for a minimum of 60 minutes to assure the destruction of Emerald Ash Borer (*Agrilus plantpennis*), as specified under 7 CFR § 301.53. The USDA has a testing protocol which inserts one or more temperature probes within one or more pieces of firewood to ensure that the kiln and the treatment process used by that kiln results in bringing the core temperature into the prescribed range for the prescribed period. The USDA test equipment is temporary but similar temperature probes with permanent wiring could be added to the kiln. The process would need to have a way for the baskets to be moved into and out of the kiln without damage to the probe wiring.

Basket Use.

While this disclosure had a focus on the drying of firewood within baskets, the teachings of the present disclosure, including the improved basket designs could be used in kilns that did not dry firewood at all but used baskets for other small random wood lengths such as finger joint boards or any other product that does not lend itself to stacking.

One of skill in the art will recognize that some of the alternative implementations set forth above are not universally mutually exclusive and that in some cases additional implementations can be created that employ aspects of two or more of the variations described above. Likewise, the present disclosure is not limited to the specific examples or particular embodiments provided to promote understanding of the various teachings of the present disclosure. Moreover, the any claims based upon this disclosure should be interpreted to cover the range of variations, modifications, and substitutes for the components described herein as would be known to those of skill in the art.

What is claimed is:

1. A process for heat treating firewood in baskets containing firewood, the process comprising:

obtaining access to a kiln, the kiln having:

a burner side wall with a return duct to allow air to leave the kiln to enter a mixing chamber to be heated and subsequently supplied to the kiln by a supply duct that provides heated air to above a fan deck and through a set of downcomers;

an opposite side wall that is opposite the burner side wall;

a burner side placement area and an opposite side placement area, each placement area for receiving at least one basket containing firewood, the burner side placement area and the opposite side placement area separated by the set of downcomers that provide heated air between the burner side placement area and the opposite side placement area;

a first end wall between the burner side wall and the opposite side wall;

a second end wall between the burner side wall and the opposite side wall and opposite the first end wall;

at least one door so that a first set of baskets containing firewood and a second set of baskets containing firewood may be moved into the burner side placement area and the opposite side placement area through at least one of the first end wall and the second end wall;

a set of fans located in a fan wall above the fan deck to promote air circulation of a loaded kiln; the set of fans discharging to promote air circulation moving parallel to the first end wall and perpendicular to the burner side wall, the air circulation traveling from a discharge side of the set of fans, downward, through the first set of baskets containing firewood on the discharge side of the set of fans, through gaps between the set of downcomers while receiving heated air from the set of downcomers, through the second set of baskets containing firewood on an inlet side of the set of fans and upward to the inlet side of the set of fans, the set of fans adapted to periodically change a direction of fan rotation to reverse the inlet side of the set of fans with the discharge side of the set of fans; and a set of roof vents to remove water vapor from the kiln;

opening the at least one door;

loading the two placement areas with baskets containing firewood;

closing the at least one door;

applying an application of heat to heat treat the firewood, the application of heat comprising:

heating air for the kiln in the mixing chamber and returning the heated air to the kiln through the supply duct;

periodically changing the direction of fan rotation to reverse the inlet side of the set of fans with the discharge side of the set of fans;

circulating the heated air within the kiln until a dry bulb temperature reaches an initial target dry bulb temperature above 230 degrees Fahrenheit;

after reaching the initial target dry bulb temperature, increasing a wet bulb temperature depression to a target while attempting to maintain the dry bulb temperature within a selected tolerance with respect to the initial target dry bulb temperature;

after a period of operation with a dry bulb temperature within tolerance of the initial target dry bulb temperature and the wet bulb temperature depression at the target, stopping addition of heat to the kiln;

opening the at least one door;

removing the baskets containing firewood from the burner side placement area and the opposite side placement area through the at least one door; and wherein removing the baskets containing firewood from the burner side placement area and the opposite side placement area occurs within 24 hours of closing the at least one door before applying the application of heat to heat treat the firewood.

2. The process claim 1 wherein the set of fans are run in a first direction for a period of time and then run in the opposite direction for a period of time to reverse the inlet side of the set of fans with the discharge side of the set of fans.

3. The process of claim 1 wherein the kiln does not have tracks in the burner side placement area and the opposite side placement area for use in receiving carts carrying wood to be heat treated.

4. The process of claim 1 further comprising moving baffles within the kiln from a loading position where the baffles do not prevent loading of baskets containing firewood into the kiln;

to an operating position wherein the baffles reduce an amount of air that moves from the discharge side of the set of fans to the inlet side of the set of fans without passing through at least one basket containing firewood in the opposite side placement area and at least one basket containing firewood in the burner side placement area.

5. The process of claim 1 wherein the firewood after an end of the application of heat has less than 20% moisture content by weight.

6. The process of claim 1 wherein the baskets containing firewood are moved into and out of the kiln via forklift wherein the forklift moves baskets containing firewood substantially perpendicular to a direction of air flow during operation of the kiln as the set of fans promotes air circulation moving parallel to the first end wall and perpendicular to the burner side wall.

7. The process of claim 1 wherein: a volume of natural gas is used to provide heat to the kiln and the volume of natural gas used is below 3K standard cubic feet per cord of firewood to dry green firewood to less than 20% moisture content by weight.

8. The process of claim 7 wherein a volume of natural gas is used to provide heat to the kiln that processes more than 40 cords of firewood per application of heat to heat treat the firewood and the volume of natural gas used is below 2800 standard cubic feet per cord of firewood to dry green firewood to less than 20% moisture content by weight.

9. The process of claim 1 wherein the process uses a total amount of electrical energy for moving air during the process for heat treating firewood in baskets containing firewood is not more than 74 kwh/cord of firewood.

10. A process for heat treating firewood in baskets containing firewood, the process comprising:

obtaining access to a kiln, the kiln having:

a burner side wall with a return duct to allow air to leave the kiln to enter a mixing chamber to be heated and subsequently supplied to the kiln by a supply duct that provides heated air to above a fan deck and through a set of downcomers;

an opposite side wall that is opposite the burner side wall;

a burner side placement area and an opposite side placement area, each placement area for receiving at least one basket containing firewood, the burner side placement area and the opposite side placement area separated by the set of downcomers that provide heated air between the burner side placement area and the opposite side placement area;

a first end wall between the burner side wall and the opposite side wall;

a second end wall between the burner side wall and the opposite side wall and opposite the first end wall;

at least one door so that a first set of baskets containing firewood and a second set of baskets containing firewood may be moved into the burner side placement area and the opposite side placement area through at least one of the first end wall and the second end wall;

a set of fans located in a fan wall above the fan deck to promote air circulation of a loaded kiln; the set of fans discharging to promote air circulation moving parallel to the first end wall and perpendicular to the burner side wall, the air circulation traveling from a discharge side of the set of fans, downward, through the first set of baskets containing firewood on the discharge side of the set of fans, through gaps between the set of downcomers while receiving heated air from the set of downcomers, through the second set of baskets containing firewood on an inlet side of the set of fans and upward to the inlet side of the set of fans, the set of fans adapted to periodically change a direction of fan rotation to reverse the inlet side of the set of fans with the discharge side of the set of fans; and a set of roof vents to remove water vapor from the kiln;

opening the at least one door;

loading the burner side placement area and the opposite side placement area with baskets containing firewood;

closing the at least one door;

applying an application of heat to heat treat the firewood, the application of heat comprising:

heating air for the kiln in the mixing chamber and returning the heated air to the kiln through the supply duct;

periodically changing the direction of fan rotation to reverse the inlet side of the set of fans with the discharge side of the set of fans;

circulating the heated air within the kiln until a dry bulb temperature reaches an initial target dry bulb temperature above 230 degrees Fahrenheit;

after reaching the initial target dry bulb temperature, increasing a wet bulb temperature depression to a target while attempting to maintain the dry bulb temperature within a selected tolerance with respect to the initial target dry bulb temperature;

after a period of operation with a dry bulb temperature within tolerance of the initial target dry bulb temperature and the wet bulb temperature depression at the target, stopping addition of heat to the kiln;

opening the at least one door;

removing the baskets containing firewood from the burner side placement area and the opposite side placement area through the at least one door; and wherein a subset of the set of roof vents to remove water vapor from the kiln are selectively opened on only the discharge side of the set of fans while leaving closed a subset of the set of roof vents on the inlet side of the set of fans to allow moist air to be forced out of the kiln.

11. A process for heat treating firewood in baskets containing firewood, the process comprising:

obtaining access to a kiln, the kiln having:

a first side wall with a return duct to allow air to leave the kiln to enter a mixing chamber to be heated and subsequently supplied to the kiln by a supply duct that provides heated air to above a fan deck;

an opposite side wall that is opposite the first side wall;

a first side placement area for receiving at least one basket containing firewood;

a first end wall between the first side wall and the opposite side wall;

a second end wall between the first side wall and the opposite side wall and opposite the first end wall;

at least one door so that a first set of baskets containing firewood may be moved into the first side placement area through at least one of the first end wall and the second end wall;

a set of fans located in a fan wall above the fan deck to promote air circulation of a loaded kiln; the set of fans discharging to promote air circulation moving parallel to the first end wall and perpendicular to the first side wall, the air circulation traveling from a discharge side of the set of fans, downward, through the first set of baskets containing firewood on the discharge side of the set of fans, upward to an inlet side of the set of fans; and opening the at least one door;

loading the first side placement area with baskets containing firewood;

closing the at least one door;

applying an application of heat to heat treat the firewood, the application of heat comprising:

heating air for the kiln in the mixing chamber and returning the heated air to the kiln through the supply duct;

circulating the heated air within the kiln and;

after a period of operation, stopping addition of heat to the kiln;

opening the at least one door;

removing the baskets containing firewood from the first side placement area through the at least one door; and wherein at least one of the at least one basket containing firewood have a firewood portion of the basket containing firewood and a fork portion of the basket containing firewood, the fork portion of the at least one basket containing firewood having forklift accepting openings on at least one side of the at least one basket containing firewood and the forklift accepting openings are uniformly arranged to be pointing towards the at least one door used to bring the baskets containing firewood into the kiln and the fork portion of the basket containing firewood is adapted to block heated air from moving from the discharge side of the set of fans to the inlet side of the set of fans from traversing though the fork portion of the basket containing firewood.

12. The process of claim 11 wherein the baskets containing firewood have side screening facing circulating air from the air circulation, the side screening having more than 60% open area.

13. The process of claim 11 wherein the baskets containing firewood have side screening facing circulating air from the air circulation, the side screening having more than 80% open area.

14. The process of claim 11 wherein all of the baskets containing firewood loaded into the first side placement area have the firewood portion of the baskets containing firewood and the fork portion of the baskets containing firewood, the fork portion of the baskets containing firewood having forklift accepting openings and the forklift accepting openings are uniformly arranged to be pointing towards the at least one door used to bring the baskets containing firewood into the kiln and the fork portion of the baskets containing firewood is adapted to block heated air from moving from the discharge side of the set of fans to the inlet side of the set of fans from traversing though the fork portion of the baskets containing firewood.

15. The process of claim 11 wherein the set of fans are adapted to periodically change a direction of fan rotation to reverse the inlet side of the set of fans with a discharge side of the set of fans; and heating air for the kiln in the mixing chamber and returning the heated air to the kiln through the supply duct includes periodically changing the direction of fan rotation to reverse the inlet side of the set of fans with the discharge side of the set of fans.

16. The process of claim 11 wherein:

the kiln further comprises a set of downcomers that provide heated air between the first side placement area and an opposite side placement area; and loading the first side placement area with baskets containing firewood is a part of loading the first side placement area and the opposite side placement area with baskets containing firewood.

17. The process of claim 11 wherein at least one basket containing firewood has a lid to reduce airflow that travels above the firewood held in that basket containing firewood.

18. A process for heat treating firewood in baskets containing firewood, the process comprising:

obtaining access to a kiln, the kiln having:

a burner side wall with a return duct to allow air to leave the kiln to enter a mixing chamber to be heated and subsequently supplied to the kiln by a supply duct that provides heated air to above a fan deck and through a set of downcomers;

an opposite side wall that is opposite the burner side wall;

a burner side placement area and an opposite side placement area, each placement area for receiving at least one basket containing firewood, the burner side placement area and the opposite side placement area separated by the set of downcomers that provide heated air between the burner side placement area and the opposite side placement area;

a first end wall between the burner side wall and the opposite side wall;

a second end wall between the burner side wall and the opposite side wall and opposite the first end wall;

at least one door so that a first set of baskets containing firewood and a second set of baskets containing firewood may be moved into the burner side placement area and the opposite side placement area through at least one of the first end wall and the second end wall;

a set of fans located in a fan wall above the fan deck to promote air circulation of a loaded kiln; the set of fans discharging to promote air circulation moving parallel to the first end wall and perpendicular to the burner side wall, the air circulation traveling from a discharge side of the set of fans, downward, through the first set of baskets containing firewood on the discharge side of the set of fans, through gaps between the set of downcomers while receiving heated air from the set of downcomers, through the second set of baskets containing firewood on an inlet side of the set of fans and upward to the inlet side of the set of fans, the set of fans adapted to periodically change a direction of fan rotation to reverse the inlet side of the set of fans with the discharge side of the set of fans; and a set of roof vents to remove water vapor from the kiln;

opening the at least one door;

loading the burner side placement area and the opposite side placement area with baskets containing firewood;

closing the at least one door;

applying an application of heat to heat treat the firewood, the application of heat comprising:

heating air for the kiln in the mixing chamber and returning the heated air to the kiln through the supply duct;

periodically changing the direction of fan rotation to reverse the inlet side of the set of fans with the discharge side of the set of fans;

circulating the heated air within the kiln until a dry bulb temperature reaches an initial target dry bulb temperature above 230 degrees Fahrenheit;

after reaching the initial target dry bulb temperature, increasing a wet bulb temperature depression to a target while attempting to maintain the dry bulb temperature within a selected tolerance with respect to the initial target dry bulb temperature;

after a period of operation with a dry bulb temperature within tolerance of the initial target dry bulb temperature and the wet bulb temperature depression at the target, stopping addition of heat to the kiln;

opening the at least one door;

removing the baskets containing firewood from the burner side placement area and the opposite side placement area through the at least one door; and wherein at least one basket containing firewood has a lid to reduce airflow that travels above the firewood held in that basket containing firewood.

19. The process of claim 18 wherein the baskets containing firewood have side screening facing circulating air from the air circulation, the side screening having more than 60% open area.

20. The process of claim 18 wherein the baskets containing firewood have side screening facing circulating air from the air circulation, the side screening having more than 80% open area.

21. A process for heat treating firewood in baskets containing firewood, the process comprising:

obtaining access to a kiln, the kiln having:

a burner side wall with a return duct to allow air to leave the kiln to enter a mixing chamber to be heated and subsequently supplied to the kiln by a supply duct that provides heated air to above a fan deck and through a set of downcomers;

an opposite side wall that is opposite the burner side wall;

a burner side placement area and an opposite side placement area, each placement area for receiving at least one basket containing firewood, the burner side placement area and the opposite side placement area separated by the set of downcomers that provide heated air between the burner side placement area and the opposite side placement area;

a first end wall between the burner side wall and the opposite side wall;

a second end wall between the burner side wall and the opposite side wall and opposite the first end wall;

at least one door so that a first set of baskets containing firewood and a second set of baskets containing firewood may be moved into the burner side placement area and the opposite side placement area through at least one of the first end wall and the second end wall;

a set of fans located in a fan wall above the fan deck to promote air circulation of a loaded kiln; the set of fans discharging to promote air circulation moving parallel to the first end wall and perpendicular to the burner side wall, the air circulation traveling from a discharge side of the set of fans, downward, through the first set of baskets containing firewood on the discharge side of the set of fans, through gaps between the set of downcomers while receiving heated air from the set of downcomers, through the second set of baskets containing firewood on an inlet side of the set of fans and upward to the inlet side of the set of fans, the set of fans adapted to periodically change a direction of fan rotation to reverse the inlet side of the set of fans with the discharge side of the set of fans; and a set of roof vents to remove water vapor from the kiln;

opening the at least one door;

loading the burner side placement area and the opposite side placement area with baskets containing firewood;

closing the at least one door;

applying an application of heat to heat treat the firewood, the application of heat comprising:

heating air for the kiln in the mixing chamber and returning the heated air to the kiln through the supply duct;

periodically changing the direction of fan rotation to reverse the inlet side of the set of fans with the discharge side of the set of fans;

opening the at least one door;

removing the baskets containing firewood from the burner side placement area and the opposite side placement area through the at least one door; and wherein a subset of the set of roof vents to remove water vapor from the kiln are selectively opened on only the discharge side of the set of fans while leaving closed a subset of the set of roof vents on the inlet side of the set of fans to allow moist air to be forced out of the kiln.

22. The process of claim 21 wherein a volume of natural gas is used to provide heat to the kiln and the volume of natural gas used is below 3K standard cubic feet per cord of firewood to dry green firewood to less than 20% moisture content by weight.

23. The process of claim 21 wherein a volume of natural gas is used to provide heat to the kiln that processes more than 40 cords of firewood per application of heat to heat treat the firewood and the volume of natural gas used is below 2800 standard cubic feet per cord of firewood to dry green firewood to less than 20% moisture content by weight.

24. The process of claim 21 wherein the process uses a total amount of electrical energy for moving air during the process for heat treating firewood in baskets containing firewood is not more than 74 kwh/cord of firewood.

* * * * *